US008413767B2

(12) United States Patent
Nakashima

(10) Patent No.: US 8,413,767 B2
(45) Date of Patent: Apr. 9, 2013

(54) ELEVATOR OPERATION CONTROL DEVICE

(75) Inventor: Hidenobu Nakashima, Aichi (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 12/992,834

(22) PCT Filed: Aug. 11, 2008

(86) PCT No.: PCT/JP2008/064417

§ 371 (c)(1),
(2), (4) Date: Nov. 15, 2010

(87) PCT Pub. No.: WO2010/018616

PCT Pub. Date: Feb. 18, 2010

(65) Prior Publication Data

US 2011/0061975 A1 Mar. 17, 2011

(51) Int. Cl.
*B66B 1/20* (2006.01)

(52) U.S. Cl.
USPC ..... 187/384; 187/392

(58) Field of Classification Search ..... 187/247, 187/248, 380–388, 391–393, 396
See application file for complete search history.

(56) References Cited

U.S. PATENT DOCUMENTS

| | | | | |
|---|---|---|---|---|
| 5,345,049 | A * | 9/1994 | Bahjat et al. | 187/382 |
| 6,394,232 | B1 * | 5/2002 | Iwata et al. | 187/382 |
| 6,601,678 | B2 * | 8/2003 | Kostka et al. | 187/383 |
| 7,014,015 | B2 * | 3/2006 | Nikovski et al. | 187/382 |
| 7,281,610 | B2 * | 10/2007 | Ylinen et al. | 187/382 |
| 7,610,995 | B2 * | 11/2009 | Ylinen et al. | 187/382 |
| 8,157,059 | B2 * | 4/2012 | Takeuchi et al. | 187/396 |
| 2012/0145488 | A1 * | 6/2012 | Nakashima | 187/389 |

FOREIGN PATENT DOCUMENTS

| | | |
|---|---|---|
| JP | 07 232867 | 9/1995 |
| JP | 2001 287876 | 10/2001 |
| JP | 2003 312947 | 11/2003 |
| JP | 2005 119877 | 5/2005 |
| JP | 2005 132549 | 5/2005 |
| JP | 2005-263363 | 9/2005 |

(Continued)

OTHER PUBLICATIONS

International Search Report issued Apr. 7, 2009 in PCT/JP08/064417 filed Aug. 11, 2008.

(Continued)

*Primary Examiner* — Anthony Salata
(74) *Attorney, Agent, or Firm* — Oblon, Spivak, McClelland, Maier & Neustadt, L.L.P.

(57) ABSTRACT

There is provided an elevator operation control device in which for an elevator provided with a destination floor reservation device in an elevator hall, disadvantages can be overcome reliably that a user who observes a predetermined riding rule cannot ride on the elevator because of a user who does not observe the riding rule and that the operation efficiency of elevator is lowered. For this purpose, the destination floor reservation device is provided in an elevator hall so that a user registers his/her own destination floor using the destination floor reservation device. Also, when a car stops at the elevator hall, a non-reservation user riding on the car without registering the destination floor using the destination floor reservation device is detected based on the information on the user having registered the destination floor using the destination floor reservation device and the information on the user in the car. Further, when the non-reservation user is detected, the car is inhibited from starting from the elevator hall, and the car is stopped at the elevator hall.

8 Claims, 3 Drawing Sheets

FOREIGN PATENT DOCUMENTS

JP 2005-320152 11/2005

OTHER PUBLICATIONS

U.S. Appl. No. 13/391,873, filed Feb. 23, 2012, Nakashima.
Korean Office Action issued Jun. 7, 2012 in Patent Application No. 10-2010-7027411 with Partial English Translation.
Office Action (with English translation) mailed on Jan. 29, 2013, in counterpart Japanese Appln No. 2010-524631 (5 pages).
Office Action (with English translation) mailed on Jan. 5, 2013, in counterpart Chinese Appln No. 200880130188.4 (8 pages).

* cited by examiner

ELEVATOR OPERATION CONTROL DEVICE

TECHNICAL FIELD

The present invention relates to an elevator operation control device configured such that an elevator user can register his/her own destination floor in an elevator hall.

BACKGROUND ART

Some elevators are configured such that a user can register his/her own destination floor in an elevator hall by using a destination floor reservation device provided in the elevator hall (for example, refer to Patent Document 1). Such elevators are operated on the assumption that all users intending to use the elevator register their own destination floors by using the destination floor reservation device. That is, an operation control device for controlling the elevator operation obtains the number of riding passengers based on the information sent from the destination floor reservation device, and instructs an elevator best suitable for the number of riding passengers to respond.

In some cases, however, when an elevator is used, only the representative of a group intending to use the same elevator registers his/her destination floor, or a person knowing that any other person has registered the same destination floor as his/her own destination floor rides on the same elevator as the elevator on which the other person rides without operating the destination floor reservation device. In such a case, the number of users having registered the destination floor using the destination floor reservation device (the number of passengers obtained by the operation control device) does not correspond with the actual number of passengers in the car. Therefore, the elevator becomes full-load before the user having registered the destination floor properly using the destination floor reservation device rides on the elevator, so that there is a possibility that the said user cannot ride on the designated elevator.

As a prior art for solving this kind of problem, an operation control device described in Patent Document 2 has been proposed. In the operation control device described in Patent Document 2, when an elevator becomes full-load, an operation for causing the passenger in the car to get off is performed preferentially. Subsequently, when the full-load condition of elevator is resolved, the elevator is caused to respond preferentially to a call that has been unable to be responded because of the preference given to the getting-off passenger.

Patent Document 1: Japanese Patent Laid-Open No. 2001-287876

Patent Document 2: Japanese Patent Laid-Open No. 2005-119877

DISCLOSURE OF THE INVENTION

Problems to be Solved by the Invention

The operation control device described in Patent Document 2 provides one solution to the above-described problem. However, this device has problems that the waiting time of user having registered the destination floor properly using the destination floor reservation device is long and that the operation efficiency of elevator is lowered.

Also, because of the user who does not observe the riding rule that the user rides on an elevator after registering his/her own destination floor in a hall, the waiting time of the user who observes the riding rule becomes long. Therefore, this solution is not a fair one.

The present invention has been made to solve problems as described above and the object of the invention is to provide an elevator operation control device in which for an elevator provided with a destination floor reservation device in an elevator hall, disadvantages can be overcome reliably that a user who observes a predetermined riding rule cannot ride on the elevator because of a user who does not observe the riding rule and that the operation efficiency of elevator is lowered.

Means for Solving the Problems

An elevator operation control device according to the present invention is an elevator operation control device which comprises a destination floor reservation device provided in an elevator hall so that an elevator user registers a destination floor in the elevator hall, a non-reservation riding detecting section which detects a user riding on a car of elevator without registering the destination floor using the destination floor reservation device when the car stops at the elevator hall based on the information on the user having registered the destination floor using the destination floor reservation device and the information on the user in the car, and a start inhibiting section which inhibits the car from starting from the elevator hall when the user riding on the car without registering the destination floor using the destination floor reservation device is detected by the non-reservation riding detecting section.

Effect of the Invention

According to the present invention, for an elevator provided with a destination floor reservation device in an elevator hall, disadvantages can be overcome reliably that a user who observes a predetermined riding rule cannot ride on the elevator because of a user who does not observe the riding rule and that the operation efficiency of elevator is lowered.

BRIEF OF DESCRIPTION OF THE DRAWINGS

DESCRIPTION OF SYMBOLS

| | |
|---|---|
| 1 | car, |
| 2 | destination floor reservation device, |
| 3 | body weight measuring device, |
| 4 | car call button, |
| 5 | announcement issuing device, |
| 6 | load weighing device, |
| 7 | input button, |
| 8 | display panel, |
| 9 | control device, |
| 10 | destination reservation receiving section, |
| 11 | destination reservation management section, |
| 12 | riding weight management section, |

-continued

| | |
|---|---|
| 13 | car load detecting section, |
| 14 | non-reservation riding detecting section, |
| 15 | non-reservation riding judging section, |
| 16 | start inhibiting section, |
| 17 | operation control section, |
| 18 | announcement issuing section, |
| 19 | CPU, |
| 20 | ROM, |
| 21 | RAM, |
| 22 | converter |

BEST MODE FOR CARRYING OUT THE INVENTION

The present invention will be described in more detail with reference to the accompanying drawings. Incidentally, in each of the drawings, like numerals refer to like or similar parts and redundant descriptions of these parts are appropriately simplified or omitted.

First Embodiment

Figure 1:
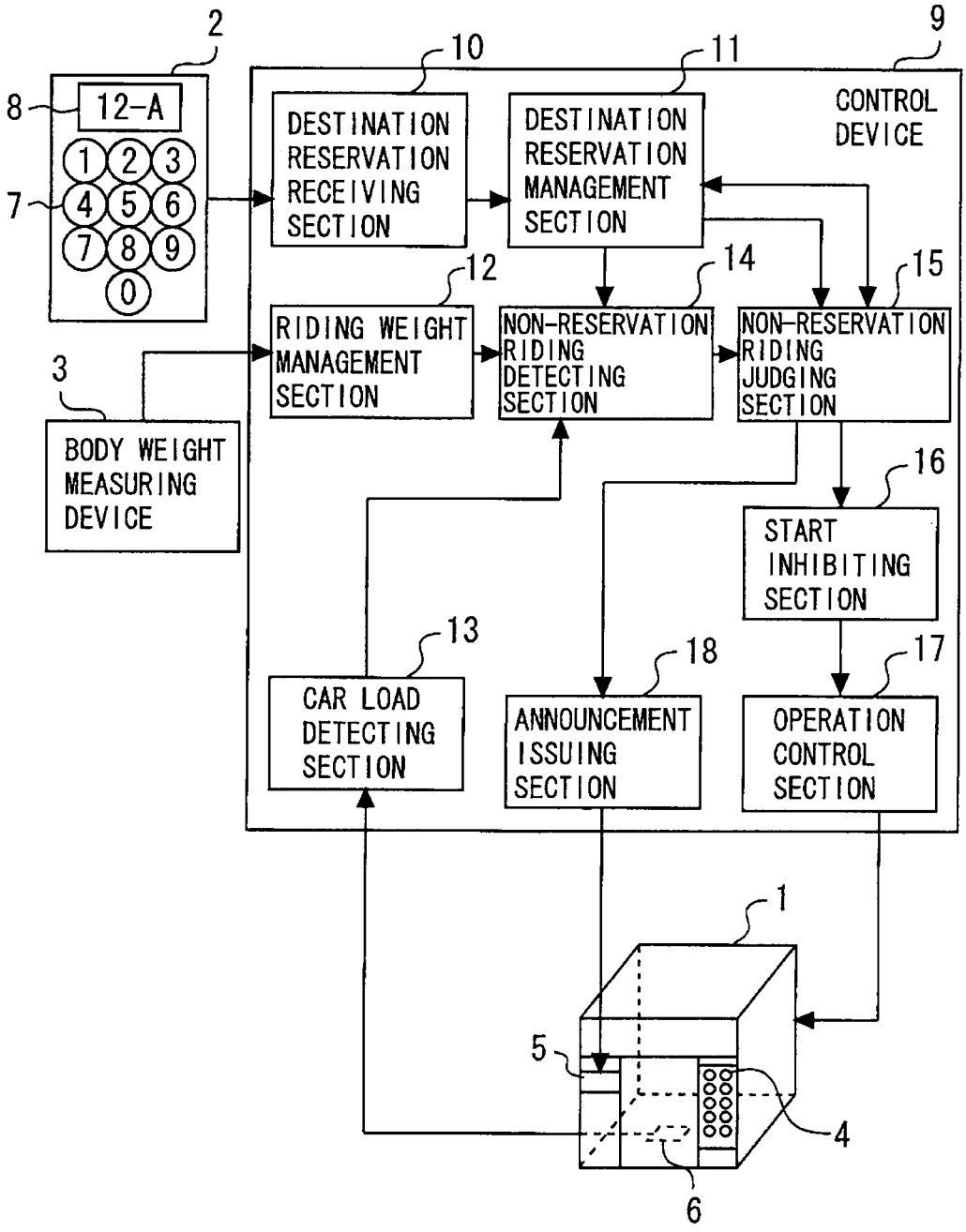
FIG. 1 is a general configuration view of an elevator operation control device in a first embodiment according to the present invention.

FIG. 1 is a general configuration view of an elevator operation control device in a first embodiment according to the present invention. In FIG. 1, symbol 1 denotes a car traveling up and down in an elevator shaft, 2 denotes a destination floor reservation device provided in each elevator hall, and 3 denotes a body weight measuring device provided together with the destination floor reservation device 2 in each elevator hall.

The car 1 is provided with well-known car call buttons 4 (a car operating panel) operated by a passenger in the car 1, an announcement issuing device 5 for issuing vocal announcement to the passenger in the car 1, a load weighing device 6 provided under a floor or the like to measure a load (carrying weight) in the car 1, and the like.

The destination floor reservation device 2 is used by an elevator user to register his/her own destination floor in an elevator hall before the user rides on the elevator. The destination floor reservation device 2 includes, for example, input buttons 7 and a display panel 8. The input buttons 7 are operated by the user when he/she inputs his/her own desired destination floor, and are configured, for example, by buttons of 0 to 9 (a numerical keypad) as shown in FIG. 1. Also, the display panel 8, which is provided to give predetermined information to the user operating the input buttons 7, displays, for example, the number or the name of the elevator responding to the destination floor registered by the user.

The body weight measuring device 3 performs the function of measuring the body weight of an operator operating the destination floor reservation device 2. That is, the body weight of a user having registered the destination floor using the destination floor reservation device 2 is measured by the body weight measuring device 3.

As the function of inputting the user's desired destination floor, in place of the input buttons 7 consisting of the numerical keypad, floor buttons may be provided, or a device capable of designating the destination floor, such as a fingerprint matching device or a card reader, may be provided. In the case where a device capable of identifying the user individual, such as a fingerprint matching device or a card reader, is provided in the elevator hall, the configuration may be such that the body weight information of the user having registered the destination floor using the destination floor reservation device 2 is acquired by the identifying device.

Symbol 9 denotes a control device for carrying out the whole of the elevator operation control. This control device 9 controls elevator operation properly based on the information sent from the devices provided in the car 1 or the information sent from devices provided in the elevator hall, such as the destination floor reservation device 2 and the body weight measuring device 3.

As described above, the destination floor reservation device 2 is provided in the elevator hall. That is, this elevator is operated on the assumption that all users register their own destination floors by using the destination floor reservation device 2. The control device 9 also has the functions of preventing the user observing such a riding rule from becoming incapable of riding on the elevator because of the user not observing the riding rule, and preventing the operation efficiency of elevator from being lowered.

Specifically, the control device 9 includes a destination reservation receiving section 10, a destination reservation management section 11, a riding weight management section 12, a car load detecting section 13, a non-reservation riding detecting section 14, a non-reservation riding judging section 15, a start inhibiting section 16, an operation control section 17, and an announcement issuing section 18.

The destination reservation receiving section 10 performs the function of receiving a destination reservation request from the destination floor reservation device 2. Specifically, by the user's operation of the destination floor reservation device 2, the destination reservation request is transmitted from the destination floor reservation device 2 to the control device 9 based on the registration information (operation information). This destination reservation request is received by the destination reservation receiving section 10, and is managed as destination reservation information by the destination reservation management section 11. That is, the destination reservation management section 11 performs the function of managing the destination reservation made by each user.

The riding weight management section 12 performs the function of managing the information on body weight measured by the body weight measuring device 3. The body weight of the user having registered the destination floor using the destination floor reservation device 2, that is, the body weight of the user having ridden on the elevator and the user intending to ride on the elevator are managed by the riding weight management section 12.

The car load detecting section 13 performs the function of detecting the load (carrying weight) in the car 1 based on the output value of the load weighing device 6.

The non-reservation riding detecting section 14 performs the function of detecting a user riding on the car 1 without registering the destination floor using the destination floor reservation device 2 (hereinafter, referred also to a "non-reservation user"). Specifically, the non-reservation riding detecting section 14 detects the above-described non-reservation user when the car 1 stops at an elevator hall based on the information on the user having registered the destination floor using the destination floor reservation device 2 and the information on the user in the car 1. For example, the non-reservation riding detecting section 14 judges whether or not the non-reservation user is present in the car 1 based on the pieces of information on the body weight measured by the body weight measuring device 3 when the destination floor is registered using the destination floor reservation device 2 and the information on the car load detected by the car load detecting section 13.

The non-reservation riding judging section 15 performs the function of judging whether or not a user having already registered the destination floor normally using the destination floor reservation device 2 (hereinafter, referred also to a "normal reservation user") becomes unable to ride on the car 1 in the case where the non-reservation user is detected by the non-reservation riding detecting section 14.

The start inhibiting section 16 performs the function of inhibiting the car 1 from starting from the elevator hall at which the car 1 stops in the case where the non-reservation user is detected by the non-reservation riding detecting section 14. In the configuration shown in FIG. 1, the start inhibiting section 16 inhibits the car 1 from starting in the case where the non-reservation user is detected by the non-reservation riding detecting section 14, and it is judged by the non-reservation riding judging section 15 that the normal reservation user becomes unable to ride on the car 1. That is, even when the non-reservation user is detected by the non-reservation riding detecting section 14, in the case where it is judged by the non-reservation riding judging section 15 that the normal reservation user does not become unable to ride on the car 1, the start inhibiting section 16 does not inhibit the car 1 from starting. The operation control section 17 controls the elevator operation properly based on the instruction given by the start inhibiting section 16.

In the case where the non-reservation user is detected by the non-reservation riding detecting section 14, and it is judged by the non-reservation riding judging section 15 that the normal reservation user does not become unable to ride on the car 1, the running of the car 1 is started with the non-reservation user being allowed to ride on. In such a case, therefore, the non-reservation riding judging section 15 registers the riding reservation up or down to the terminal floor in the running direction of the car 1 (the top floor when the car 1 is running upward, the bottom floor when the car 1 is running downward) to the destination reservation management section 11. Therefore, subsequently, the non-reservation riding detecting section 14 judges whether a new non-reservation user is present or absent considering the body weight (for example, a fixed value of 70 kg) of the user for whom the riding reservation to the terminal floor has been registered.

The announcement issuing section 18 performs the function of controlling the announcement issuing device 5. For example, when the non-reservation user is detected by the non-reservation riding detecting section 14, the announcement issuing section 18 makes an announcement to prompt the user in the car 1 to get off once and register the destination floor using the destination floor reservation device 2. In the configuration shown in FIG. 1, the announcement issuing section 18 makes the above-described announcement in the case where the non-reservation user is detected by the non-reservation riding detecting section 14, and it is judged by the non-reservation riding judging section 15 that the normal reservation user becomes unable to ride on the car 1.

Figure 2:
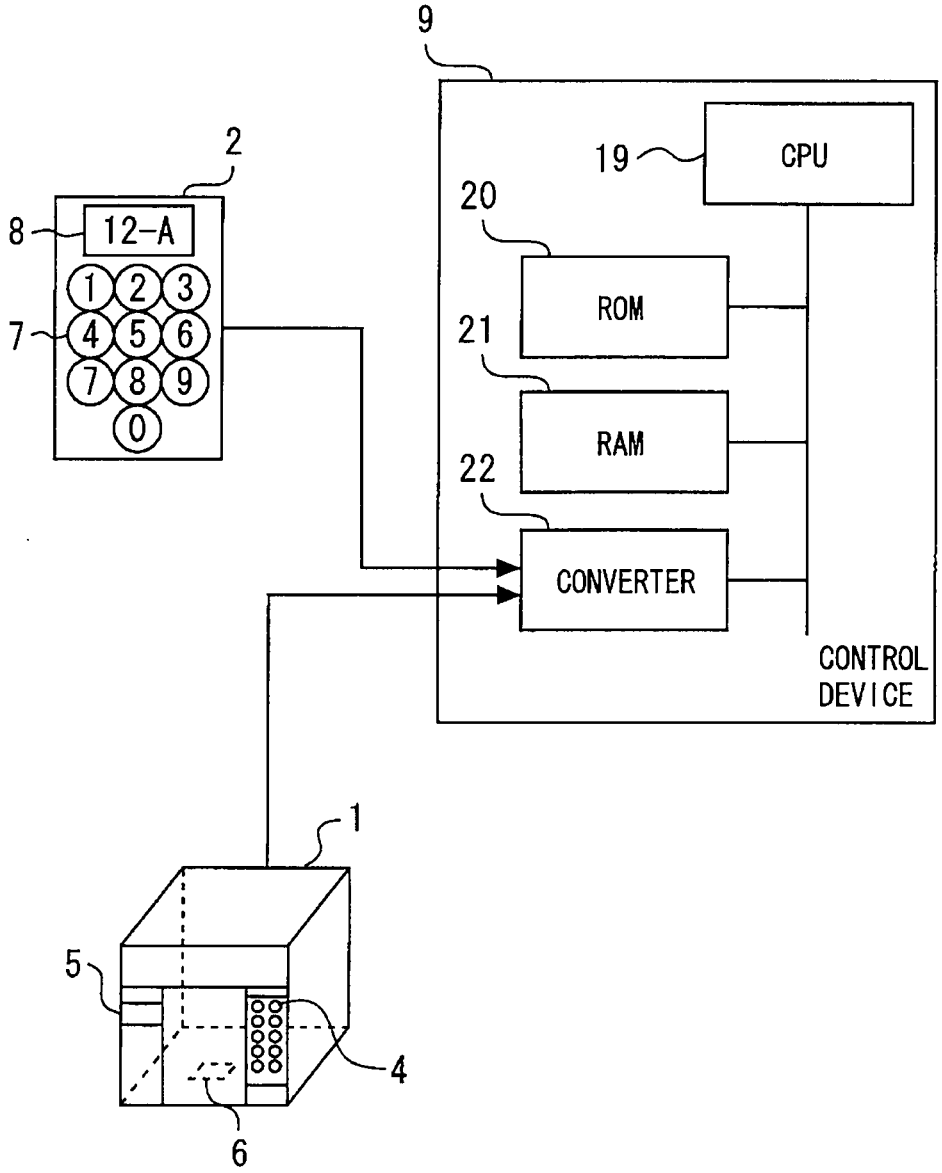
FIG. 2 is a block diagram showing a circuit configuration of the elevator operation control device in the first embodiment according to the present invention.

FIG. 2 is a block diagram showing a circuit configuration of the elevator operation control device in the first embodiment according to the present invention. In FIG. 2, a CPU 19 is a central processing unit of the control device 9 for the elevator, a ROM 20 is a read-only memory storing the operation program, and a RAM 21 is a memory storing data necessary for elevator control. Also, symbol 22 denotes a converter that converts input/output signals by connecting the pieces of equipment provided in the car 1 and the elevator hall.

Figure 3:
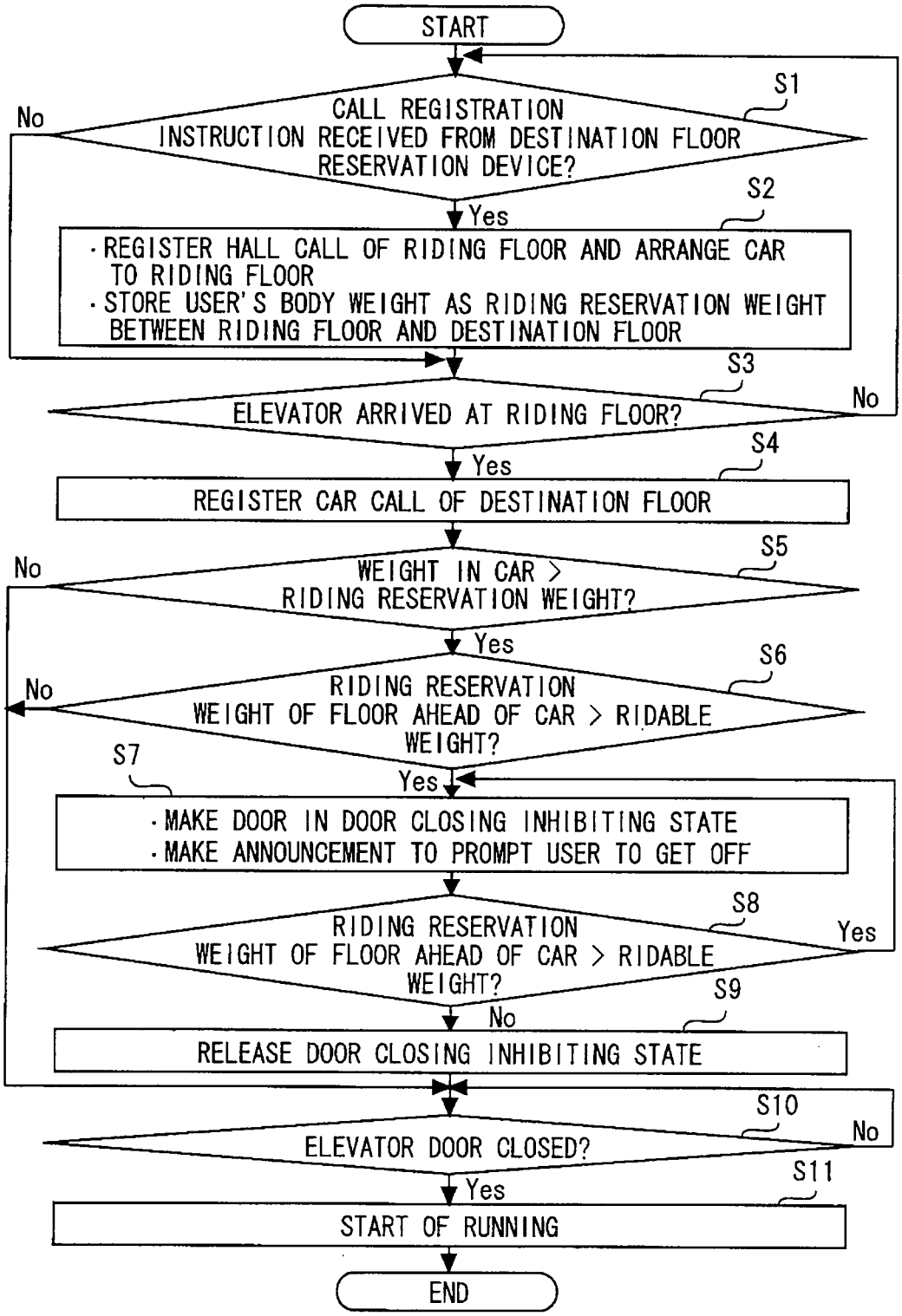
FIG. 3 is a flowchart showing the operation of the elevator operation control device in the first embodiment according to the present invention.

Next, the operation of the elevator operation control device having the above-described configuration is explained with reference to FIG. 3. FIG. 3 is a flowchart showing the operation of the elevator operation control device in the first embodiment according to the present invention. The control program shown in FIG. 3 is stored in the control device 9.

In the control device 9, first, it is judged whether or not a call registration instruction (the above-described destination reservation request) is received from the destination floor reservation device 2 provided in the elevator hall (S1). When the call registration instruction is received, the control device 9 registers the call (hall call) of the floor at which the user rides on the car 1 of elevator, and arranges the car 1 to that riding floor. At this time, the control device 9 stores the user's body weight measured by the body weight measuring device 3 as a riding reservation weight between the riding floor and the destination floor inputted by the user (S2).

Next, it is judged whether or not the car 1 has arrived at the riding floor (S3). If the car 1 has arrived at the riding floor, the car call of the floor stored as the destination floor is registered (S4). If the car 1 has not arrived at the riding floor in S3, the control returns to S1 to judge again whether or not a call registration instruction is received from the destination floor reservation device 2.

When the car call is registered in S4, the control device 9 compares the riding reservation weight in the elevator hall with the weight in the car 1 (car load) (S5). If the weight in the car 1 is heavier than the riding reservation weight, it is judged that a non-reservation user is present. If the non-reservation user is detected in S5, next, the control device 9 compares the riding reservation weight in the floor ahead of the car 1, that is, the floor at which the car 1 will stop from now on with the ridable weight of the car 1 (S6). If the riding reservation weight in the floor ahead of the car 1 is heavier than the ridable weight, it is judged that the normal reservation user becomes unable to ride on the car 1.

The ridable weight is a weight obtained by subtracting the weight in the car 1 at that time from the maximum allowable weight of the car 1.

If it is judged in S6 that the normal reservation user becomes unable to ride on the car 1, the car 1 is inhibited from starting from that elevator hall by the start inhibiting section 16. Specifically, the car 1 is stopped at the elevator hall in the state in which the door of elevator is inhibited from being closed and a door opened state is kept. Further, announcement is made to prompt the user in the car 1 to get off once and register the destination floor using the destination floor reservation device 2 (S7). The operation of S7 is continued until a state in which the normal reservation user can ride on is established (S8). Subsequently, if the riding reservation weight of the floor ahead of the car 1 becomes lighter than the ridable weight, the door closing inhibiting state is released, and the door closing operation is performed (S9). After the door closing operation has been completed, the running of the car 1 is started, and the elevator is caused to run toward the next call floor (S10, S11).

If the weight in the car 1 is lighter than the riding reservation weight in S5, or if the riding reservation weight of the floor ahead of the car 1 is lighter than the ridable weight in S6, the control proceeds to S10, and the door closing operation is performed, and the running of the car 1 is started (S11).

According to the first embodiment of the present invention, for the elevator provided with the destination floor reservation device 2 in the elevator hall, disadvantages can be overcome reliably that a user who observes a predetermined riding rule cannot ride on the elevator because of a user who does not observe the riding rule and that the operation efficiency of elevator is lowered.

Also, in the above-described embodiment, even when the non-reservation user is detected by the non-reservation riding detecting section 14, in the case where it is judged by the non-reservation riding judging section 15 that the normal reservation user does not become unable to ride on the car 1, the car 1 is not inhibited from starting. Therefore, the car 1 can be inhibited from starting only when the non-reservation user must be caused to get off, so that there is no possibility of remarkable lowering of the elevator operation efficiency.

If the riding rule that the user registers his/her own destination floor before riding on the car can be made known to the users, the above-described operation control device is made easy to use. Therefore, this operation control device is especially effective in the case where the elevator users are restricted, for example, in an office building, and therefore the riding rule can be made known to the users. Also, if the riding rule is made known, the announcement prompting the user to get off made in the car 1 is accepted without a sense of discomfort, and further the announcement prompting the user to get off is also effective in making the user conscious of the riding rule.

In the first embodiment, there has been explained the case where the body weight of the operator who operates the destination floor reservation device 2 is measured actually by providing the body weight measuring device 3 in the elevator hall. However, the configuration may be made such that the body weight per one person has been set at a fixed value (for example, 70 kg) in advance, and the value obtained by multiplying the number of users having registered the destination floor using the destination floor reservation device 2 by the fixed value of body weight is stored as the riding reservation weight.

Also, the presence of the non-reservation user can be judged by determining the number of users in the car 1 by dividing the weight in the car 1 measured using the load weighing device 6 by the predetermined fixed value of body weight and by comparing the number of users in the car 1 with the number of users having registered the destination floor using the destination floor reservation device 2.

INDUSTRIAL APPLICABILITY

As described above, the elevator operation control device in accordance with the present invention can be applied to an elevator that is provided with the destination floor reservation device in the elevator hall, and is operated on the assumption that all users intending to use the elevator register their own destination floors by using the destination floor reservation device.

The invention claimed is:

1. An elevator operation control device which comprises a destination floor reservation device provided in an elevator hall so that an elevator user registers a destination floor in the elevator hall, comprising:

a non-reservation riding detecting section which detects a user riding on a car of elevator without registering the destination floor using the destination floor reservation device when the car stops at the elevator hall based on the information on the user having registered the destination floor using the destination floor reservation device and the information on the user in the car; and a start inhibiting section which inhibits the car from starting from the elevator hall when the user riding on the car without registering the destination floor using the destination floor reservation device is detected by the non-reservation riding detecting section.

2. The elevator operation control device according to claim 1, wherein the elevator operation control device further comprises:

a body weight measuring device which is provided in the elevator hall to measure the body weight of an operator who operates the destination floor reservation device; and a car load detecting section which detects a car load; and the non-reservation riding detecting section judges whether or not the user riding on the car without registering the destination floor using the destination floor reservation device is present based on the information on the body weight measured by the body weight measuring device when the destination floor is registered using the destination floor reservation device and the information on the car load detected by the car load detecting section.

3. The elevator operation control device according to claim 1, wherein the elevator operation control device further comprises an announcement issuing section which makes an announcement to prompt the user in the car to get off once and register the destination floor using the destination floor reservation device when the user riding on the car without registering the destination floor using the destination floor reservation device is detected by the non-reservation riding detecting section.

4. The elevator operation control device according to claim 1, wherein even when the user riding on the car without registering the destination floor using the destination floor reservation device is detected by the non-reservation riding detecting section, in the case where a user having already registered the destination floor does not become unable to ride on the car, the start inhibiting section does not inhibit the car from starting from the elevator hall.

5. The elevator operation control device according to claim 4, wherein the elevator operation control device further comprises a non-reservation riding judging section which registers the riding reservation to the terminal floor in the running direction of the car when the user riding on the car without registering the destination floor using the destination floor reservation device is detected by the non-reservation riding detecting section and the user having already registered the destination floor does not become unable to ride on the car.

6. The elevator operation control device according to claim 2, wherein the elevator operation control device further comprises an announcement issuing section which makes an announcement to prompt the user in the car to get off once and register the destination floor using the destination floor reservation device when the user riding on the car without registering the destination floor using the destination floor reservation device is detected by the non-reservation riding detecting section.

7. The elevator operation control device according to claim 2, wherein even when the user riding on the car without registering the destination floor using the destination floor reservation device is detected by the non-reservation riding detecting section, in the case where a user having already registered the destination floor does not become unable to ride on the car, the start inhibiting section does not inhibit the car from starting from the elevator hall.

8. The elevator operation control device according to claim 7, wherein the elevator operation control device further comprises a non-reservation riding judging section which registers the riding reservation to the terminal floor in the running direction of the car when the user riding on the car without registering the destination floor using the destination floor reservation device is detected by the non-reservation riding detecting section and the user having already registered the destination floor does not become unable to ride on the car.

* * * * *